US005485189A

United States Patent [19]

Ebata

[11] Patent Number: 5,485,189

[45] Date of Patent: Jan. 16, 1996

[54] THERMAL FIXING APPARATUS HAVING MEMBER PROJECTING INTO RECORDING MEDIUM

[75] Inventor: Tokihide Ebata, Kawasaki, Japan

[73] Assignee: Canon Kabushiki Kaisha, Tokyo, Japan

[21] Appl. No.: 150,531

[22] Filed: Nov. 10, 1993

Related U.S. Application Data

[63] Continuation of Ser. No. 924,617, Aug. 6, 1992, abandoned, which is a continuation of Ser. No. 648,145, Jan. 30, 1991, abandoned.

[30] Foreign Application Priority Data

Feb. 2, 1990 [JP] Japan ..... 2-22232

[51] Int. Cl.[6] ..... B41J 2/01

[52] U.S. Cl. ..... 347/102; 219/216; 271/274; 271/251; 347/104

[58] Field of Search ..... 347/102, 104; 355/285–291; 219/216; 346/25; 271/251, 272, 274

[56] References Cited

U.S. PATENT DOCUMENTS

| | | | |
|---|---|---|---|
| 2,461,376 | 2/1949 | Feldmeier | 271/274 |
| 3,160,413 | 12/1964 | Faeber | 271/86 |
| 3,797,127 | 3/1974 | Yamada et al. | 34/123 |
| 3,826,896 | 7/1974 | Thompson | 219/216 X |
| 3,999,038 | 12/1976 | Sikes | 219/216 X |
| 4,034,189 | 7/1977 | Sakamaki | 219/216 |
| 4,294,556 | 10/1981 | Rix | 347/102 |
| 4,313,124 | 1/1982 | Haro et al. . | |
| 4,345,263 | 8/1982 | Tuzaki et al. . | |
| 4,419,003 | 12/1983 | Fujie | 219/216 X |
| 4,459,600 | 7/1984 | Sato et al. . | |
| 4,463,359 | 7/1984 | Ayata et al. . | |
| 4,558,333 | 12/1985 | Sugitani et al. . | |
| 4,723,129 | 2/1988 | Endo et al. . | |
| 4,740,796 | 4/1988 | Endo et al. . | |
| 4,794,224 | 12/1988 | Spektor | 219/216 |
| 5,005,025 | 4/1991 | Miyakawa | 347/102 |
| 5,023,111 | 6/1991 | Fulton | 427/164 |

FOREIGN PATENT DOCUMENTS

| | | |
|---|---|---|
| 59-123670 | 7/1984 | Japan . |
| 59-138461 | 8/1984 | Japan . |

OTHER PUBLICATIONS

Patent Abstracts of Japaqn, vol. 9, No. 264 (M–423) (1987) Oct. 22, 1985.

Patent Abstracts of Japan, vol. 9, No. 84 (M–371) (1807) Apr. 13, 1985.

Patent Abstracts of Japan, vol. 7, No. 9 (M–185) (1154) Jan. 14, 1983.

*Primary Examiner*—Joseph W. Hartary

*Attorney, Agent, or Firm*—Fitzpatrick, Cella, Harper & Scinto

[57] ABSTRACT

A thermal fixing apparatus includes a heating member for heating a recording medium by contact with its face other than that on which an image has been formed by an image forming apparatus. The face of said heating member which contacts with said recording medium is shaped, in its section perpendicular to the conveying direction for said recording medium, so that the central portion of the face extremely projects into the conveying pass side for said recording medium. The thermal fixing apparatus acts in the image forming apparatus as thermal fixing means for image fixing the recording medium on which a desired record image has been formed by the relative movement with recording means included in the image forming apparatus.

19 Claims, 4 Drawing Sheets

THERMAL FIXING APPARATUS HAVING MEMBER PROJECTING INTO RECORDING MEDIUM

This application is a continuation of now abandoned application Ser. No. 07/924,617 filed Aug. 6, 1992, which was a continuation of application Ser. No. 07/648,145 filed Jan. 30, 1991, now abandoned.

BACKGROUND OF THE INVENTION

1. Field of the Invention

This invention relates to a thermal fixing apparatus for fixing an image formed on a recording medium by heating it, and an image forming apparatus having said thermal fixing apparatus. The invention further relates to a fixing process for fixing an image on a recording medium.

In an image forming apparatus such as an ink jet recording apparatus, etc., in order to cause discharged ink to be fixed on a recording form such as a paper, film or the like (hereinafter, called a "recording medium") by drying the ink on the recording medium, many drying methods have used including controlling the conveying speed of the recording medium, emitting the recording medium after holding it at the recording position during a predetermined period of time after the completion of recording, and advancing the recording medium on a recording medium conveying path heated by a heater or the like to heat the recording medium. Particularly, the heating method for drying is noticeably recognized as what is most effective in fixation.

2. Related Background Art

FIG. 1 schematically shows a fixing unit for carrying out the fixing for a recorded image by the heating method. A recording medium 100 is conveyed or fed onto a thermal conveying path 103 heated by a heater (not shown), by two sets of conveying roller pairs 101 and two sets of form emitting or exhausting roller pairs 102, each set of roller pairs 101 and 102 being positioned at one of two image blank portions at the right and left edges of the recording medium 100. Usually, the conveying speed of the respective form emitting roller pairs 102 is set to be higher than that of the respective conveying roller pairs to give tensile force to the recording medium 100 between the roller pairs 101 and 102 in the form advancing direction (shown by arrow A), so that the recording medium can be closely contacted with the thermal conveying path 103 to provide improved fixing capability due to good thermal transferability.

However, in case where a resin or plastic film like sheet such as an OHP form (transparency) which typically comprises resin sheet material having an ink accepting layer, is used as the recording medium 100, when it contacts with the thermal conveying path 103 in the course of its advancing on the thermal conveying path 103, the film sheet should be often overheated owing to inappropriate temperature setting for the thermal advancing path, which leads the film sheet to its deformation, so that the film sheet would produce a "waving phenomenon" as shown in FIG. 2. Even though the thermal conveying path 103 is set to be such temperature that occurrence of said waving phenomenon due to overheating would be avoided, the recording medium 100 receives force acting toward its small expansion as it passes through the thermal conveying path 103. Under this condition, after the recording medium 100 has passed through the thermal conveying path 103, the recording medium receives force acting toward its contraction since the heat thereof is radiated. These two forces which are contrary to each other would be produce the waving phenomenon shown in FIG. 2. Since this waving phenomenon cannot be easily suppressed by merely applying, to the recording medium, the tensile force in the conveying direction for the recording medium, the sheet film itself would be deformed upon heating, and the raised portions of the film from the heat conveying path would not be maintained in a condition in which they are sufficiently heated, and accordingly, parts of the image on the film would not be dried sufficiently and left unfixed. Therefore, there would be reproduced a disturbed image.

SUMMARY OF THE INVENTION

This invention is intended to cope with the above-mentioned situations, and it is an object of this invention to provide a thermal fixing apparatus wherein the recording medium can be conveyed with it closely contacted to the heat conveying path while the waving phenomenon of the recording medium is suppressed, so that satisfied image fixing can be obtained, as well as image forming apparatus having such thermal fixing apparatus.

It is a further object of this invention to provide thermal fixing apparatus comprising a heating member for heating a recording medium by contact with its face other than that on which an image has been formed by an image forming apparatus, the face of said heating member which contacts with said recording medium being so shaped that, in its section perpendicular to the conveying direction for said recording medium, the central portion thereof extremely projects into the conveying pass side for said recording medium.

It is possible to shape the face of the heating member which contacts with said recording medium so that in its section parallel to the conveying direction for said recording medium, the downstream side in the conveying direction gradually and continuously projects into the conveying pass side for said recording medium in comparison with the upstream side.

Also, it is possible to arrange, at each of the both sides of said heating member in the direction perpendicular to the conveying direction for said recording medium, one or more pair of conveying members for said recording medium are settled, one of a pair for each side.

It is preferred to set up the conveying members for the recording medium so that they apply to the recording medium tensile force directing to the outside of the heating member in the direction intersecting the conveying direction for the recording medium, at the downstream side in the conveying direction for the recording medium.

It is desirable that a pair of the conveying members for the recording medium are opened at an angle ranging from 1 degree to 15 degrees at the downstream side in the conveying direction for the recording medium, toward the outside of the heating member in the direction intersecting the conveying direction for the recording medium.

It is possible to use a resin film like sheet as said recording medium.

It is a still further object of the invention to provide an image forming apparatus comprising a supporting member for supporting recording means for discharging ink from ink discharging ports, and for carrying out scanning and movement relatively with respective to a recording medium, means for conveying the recording medium on which an image be formed, and thermal fixing means for image fixing the recording medium on which a desired record image has been formed by the relative movement with said recording means to be image fixed, characterized in that said thermal fixing means is provided with a heating member for heating said recording medium by contact with its face other than that on which the image has been formed, the face of said heating member which contacts with said recording medium being so shaped that, in its section perpendicular to the conveying direction for said recording medium, the central portion thereof extremely projects into the conveying pass side for said recording medium.

It is preferable that said thermal fixing means is freely attachable to a record image forming part having said recording means and said conveying means.

The recording means may be a type wherein ink is discharged from the discharging ports by expansion and contraction of bubbles produced by the occurrence of the change of state of the ink using heat energy, and means for generating the thermal energy may comprise electrothermal converter means.

When the recording medium having an image formed on its one face by the image forming machine is conveyed onto the heating plate member, the recording medium is heated by the contact thereof with the heating member. The recording medium occurs therein thermal expansion when it is heated. The face of the heating plate member which contacts with the recording medium is so shaped that its central portion extremely protrude into the conveying path side for the recording medium. As the result of the interaction of this protruding central portion and the obliquely feeding roller arrangement, the tensile force orientated to the outside of the heating plate member in the direction intersecting the conveying direction for the recording medium. Owing to this tensile force, those portions of the recording medium which have been thermally expanded are properly tensioned. Thus, with such construction that the lateral tensile force toward the outside against the medium conveying direction is applied to the recording medium in the heating area, any stress which is applied between the portions which have been thermally expanded and such portions that the thermal expansion has not yet been received because there was no heating applied, or the contraction has already occurred after the heating was applied is cancelled, so that the waving phenomenon shown in FIG. 2 is prevented. Accordingly, since the recording medium is conveyed in fine contact with the heating plate member, this invention provides a thermal fixing apparatus having excellent fixing capability, and an image forming apparatus using the same.

Further, since the thermal fixing apparatus according to this invention is freely mountable on the main body, for example the image forming apparatus, it is usable in the main body, if necessary.

Yet another object of this invention is directed to a fixing process for fixing an image on a recording medium. More particularly, the fixing process for fixing an image on a recording medium comprises the steps of: conveying a recording medium having an image formed thereon to an image fixing area in a conveying path; applying a tension to the recording medium in a direction intersecting a conveying direction at the image fixing area in said conveying path; and heating a surface opposite to an image formed surface of the recording medium at the image fixing area so as to fix said image on the recording medium. Another embodiment of the fixing process of this invention includes applying a tension to the recording medium both in a direction intersecting the conveying direction and a direction along the conveying direction at the image fixing area in said conveying path.

The various feature and advantages of this invention will become more apparent from the following description considered together with the accompany drawings of which:

DETAILED DESCRIPTION OF THE PREFERRED EMBODIMENTS

Embodiments in accordance with the present invention will be described now with reference to the drawings.

Figure 1:
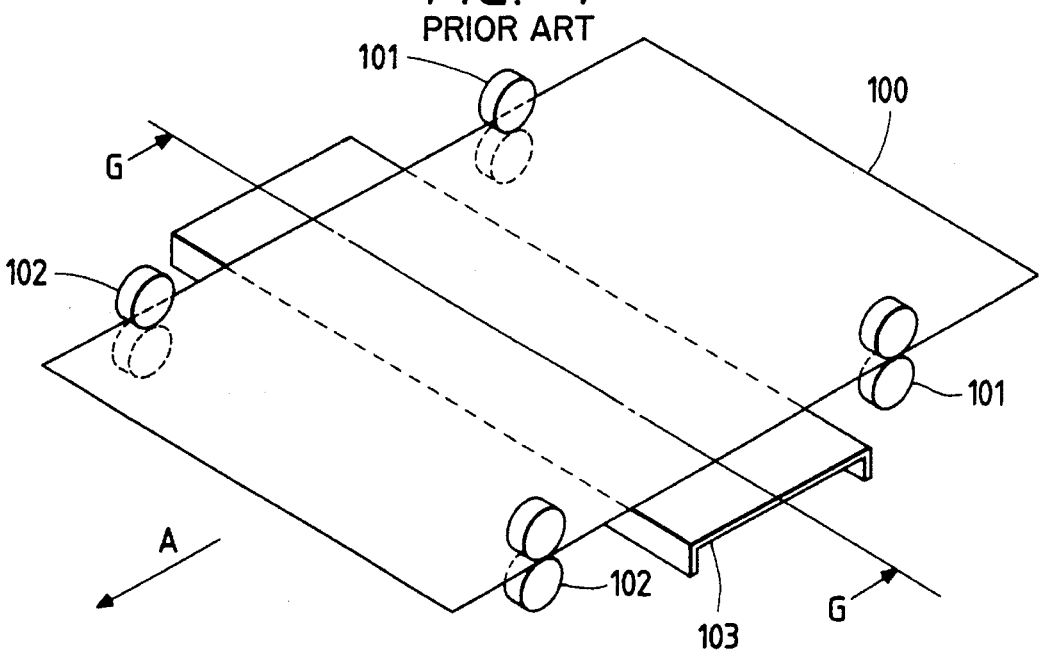
FIG. 1 PRIOR ART
FIG. 1 shows partially and perspectively one example of thermal fixing apparatus.
Figure 2:
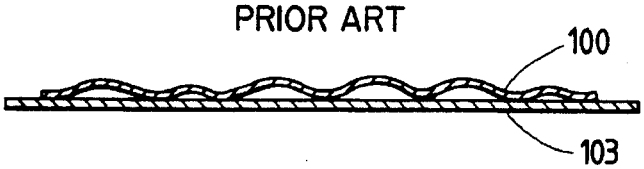
FIG. 2 PRIOR ART
FIG. 2 shows a section taken along line G—G in FIG. 1 representing the waving phenomenon relating to the recording medium which would occur in the apparatus in FIG. 1.
Figure 3:
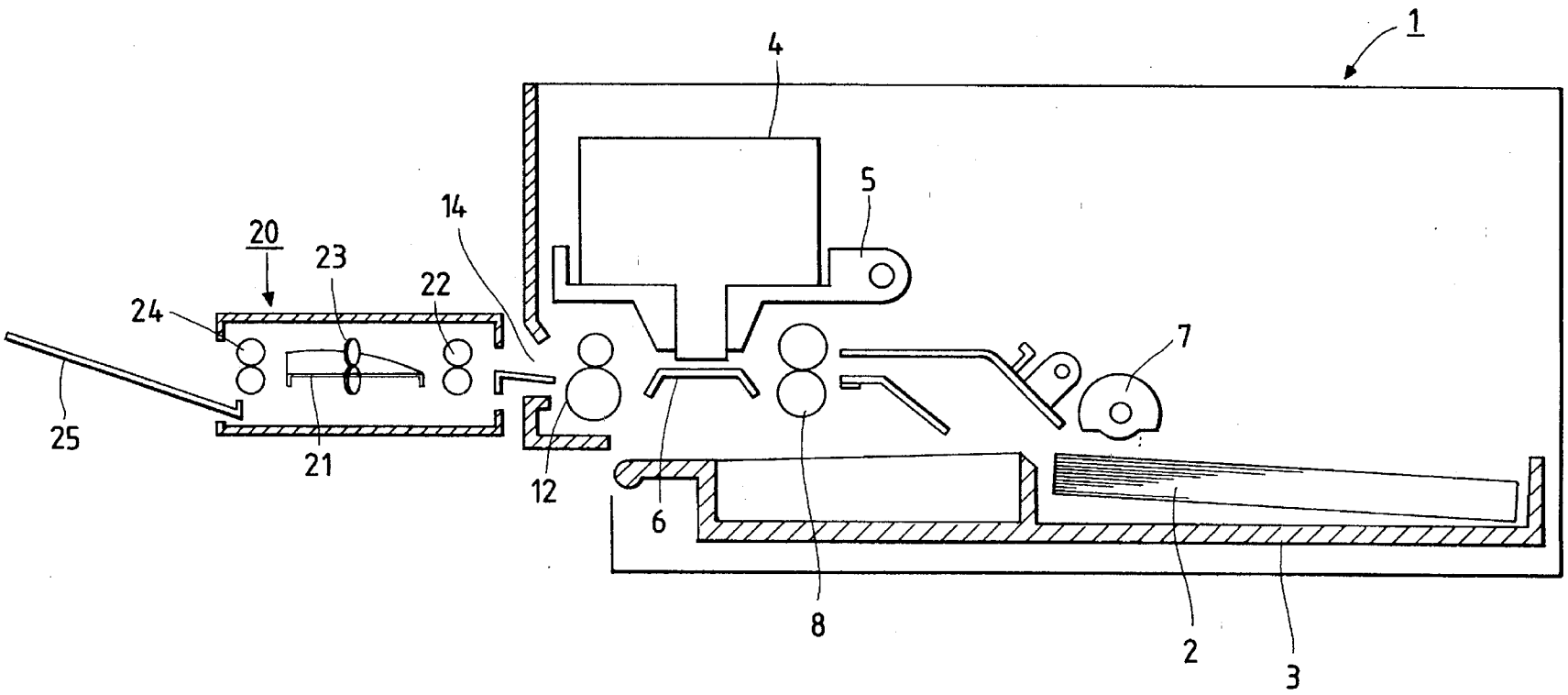
FIG. 3 schematically shows in section a thermal fixing apparatus according to one embodiment of this invention, as well as an ink jet printing machine.

FIG. 3 schematically shows in section thermal fixing apparatus according to one embodiment of the present invention as well as an image forming apparatus having an ink jet recording machine. The thermal fixing apparatus 20 is freely attachable to an attaching portion (not shown) provided in a form exhausting opening 14 of a ink jet recording machine 1, between recording means including a recording head 4 and the ink jet recording machine 1 comprising a record image forming portion including recording medium conveying means (comprising conveying roller pairs 8 and form exhausting roller pairs 12), etc., along a form feeding path. The thermal fixing apparatus 20 is mainly used as fixing means in case where recording is made to a resin film like sheet such as an OHP form, for example having an record image.

Within the ink jet recording machine 1, a cassette 3 is mounted at its bottom which supports a stack of recording media 2. At the downstream side (left side in FIG. 3) in the form feeding direction, that is the conveying direction for the recording medium, two sets of the conveying roller pairs 8 and a carriage 5 mounting and supporting the recording head 4 are arranged. The recording head 4 discharges ink from discharge ports (not shown) by the use of heat energy generated in response to the input record signal, and is provided with electrothermal converters (not shown) acting as means for generating the heat energy. A platen 6 is provided under the recording head 4. The recording medium 2 is conveyed between the recording head 4 and the platen 6 by the conveying roller pairs 8, and after the image has been formed thereon, it is exhausted from the exhausting opening 14 by left and right form exhausting roller pairs 12, the respective pair of which put therebetween the print margin areas at the both edges of the recording medium, respectively. It should be noted that the form exhausting roller pairs 12 are rotated with the form conveying roller pairs 8 interlocked thereto, the peripheral speed of the former is set to a merely faster value than that of the latter, and force holding the recording medium by the form exhausting roller pairs 12 is set to a weaker value than that by the form conveying roller pairs 8, and accordingly, resulting moderate tension in the form advancing direction which avoids any looseness of the recording medium is applied thereto.

In operation, as the recording head 4 is moved by the carriage 5 from front to back in the perpendicular direction with respect to the drawing plane, ink is discharged from the ink discharge ports of the recording head in response to the image signal, so that recording (image forming) is performed at a fixed width (recording width) on the recording medium 2. Before the recording by the recording head 4 starts, the recording medium is picked up by pick-up rollers 7 from the form tray 3, and the picked up medium is advanced to the recording area by the advancing roller pairs 8. Every time one line recording is completed, the recording medium is fed by a distance corresponding to one line length by the form conveying roller pairs so that next one line recording is produced. This operation is repeated to produce gradually the recording on the recording medium, and it is gradually fed by line steps into the thermal fixing apparatus 20 mounted in the form exhausting opening 14.

Figure 4:
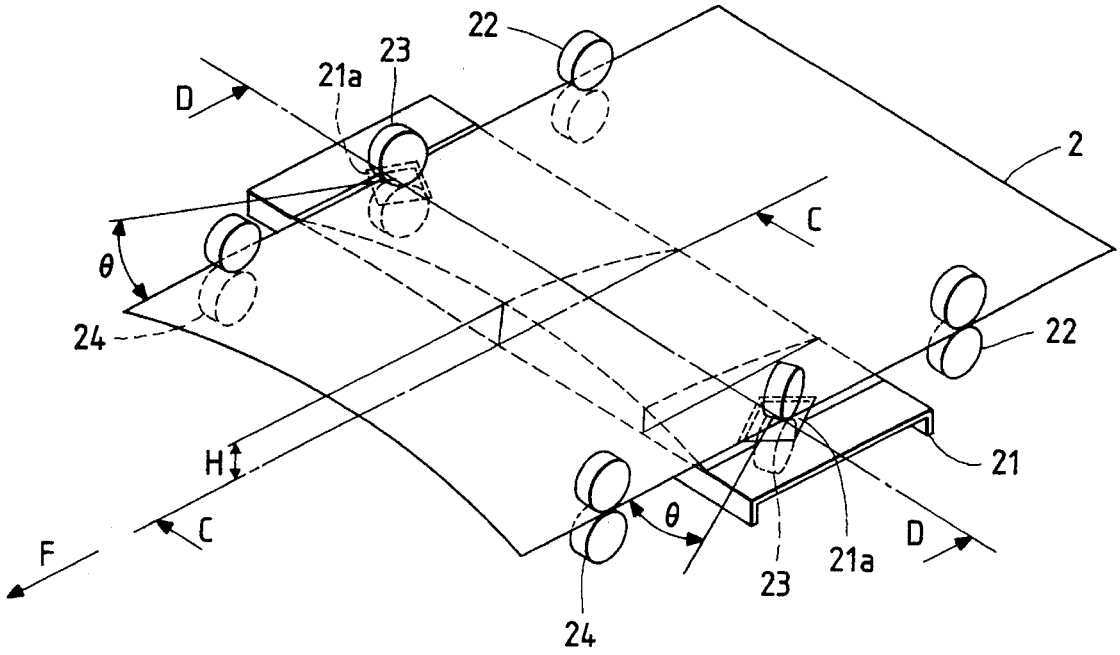
FIG. 4 perspectively shows in part a thermal heating path according to one embodiment of this invention and related parts adjacent thereto illustrated schematically.

FIG. 4 perspectively shows in part a thermal heating path according to one embodiment of the present invention and related parts adjacent thereto illustrated schematically. The recording medium 2 which has received the recording process by the ink jet recording machine 1 as above-mentioned is conveyed onto a thermal conveying path 21 which acts as a heating plate member, with the left and right blank portions of the recording medium being clamped by left and right sets of conveying roller pairs 22 functioning as a conveying member, each of which is attached to a respective driving shaft (not shown).

Figure 5:
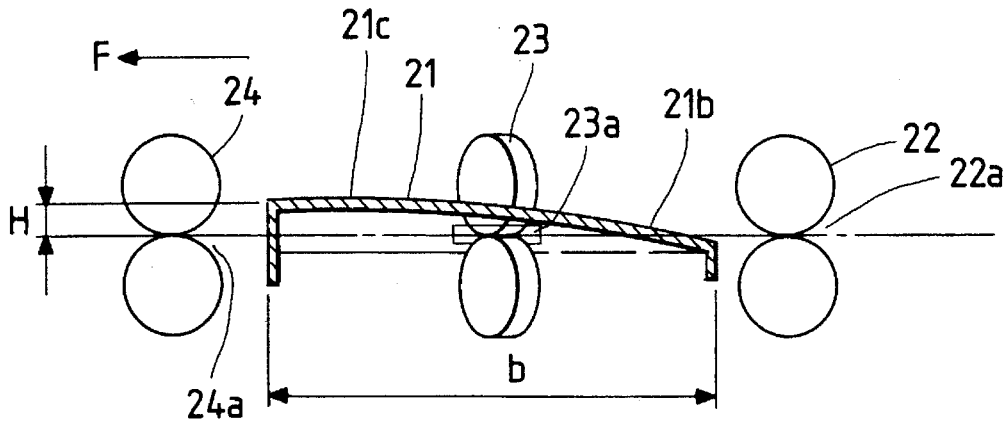
FIG. 5 shows a sectional view taken along line C—C in FIG. 4.
Figure 6:
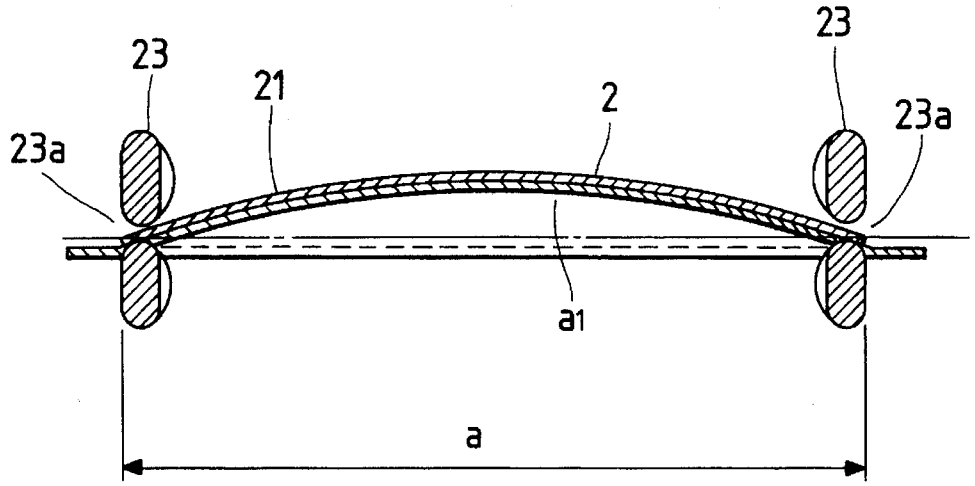
FIG. 6 shows a sectional view taken along line D—D in FIG. 4.

The thermal conveying path 21 protrudes continuously and smoothly so that the contour of section C—C in FIG. 4 parallel to the conveying direction F for the recording medium is formed to be always higher at the downstream side than at the upstream side, or it is smoothly raised and thereafter becomes equal, along the distance from the upstream end of the thermal conveying path to its downstream end, as shown in. FIG. 5. Further, section D—D perpendicular to the conveying direction F is so contoured that the central portion al positioned to the middle point of the width a of the thermal conveying path 21 extremely protrudes as shown in FIG. 6. In order to describe the shape of the thermal conveying path more clearly, following concrete working samples are now mentioned. In FIG. 5, the maximum raised value H of the thermal conveying path was selected to 3 mm from the level of the nip position of the respective conveying roller pairs 22. As for the section C—C at the central portion of the thermal conveying path, it has its length of 53 mm and an arced portion 21*b* of R=40 mm at the upstream side and a flat portion 21*c* at the downstream side, these portions being joined to each other in a body so that there is occurred no concave face. Further, as for the shape of the thermal conveying path 21 in the direction perpendicular to the position of the thermal conveying path, it has an arc with the abovementioned maximum raised value of H=3 mm as seen at the flat portion 21*c* for the width of a=220 mm of the thermal conveying path 21. The thermal conveying path 21 was worked up by pressing and cutting plate material such as aluminum to obtain the above-mentioned size and shape. The thermal conveying path is provided with a heater (not shown) attached thereto at its back for heating the thermal conveying path 21 wholly and uniformly. This heater may be a heating wire or a surface like heater directly attached to the back face of the thermal conveying path, and in that case temperature controlling means including a thermocouple circuit may be provided for measuring the temperature of the thermal conveying path to control it to a desired temperature.

Two sets of obliquely feeding roller pairs 23 are fixed to respective driving means (not shown), which act through square holes 21*a* each for one of the obliquely feeding roller pairs, which are formed in the thermal conveying path 21 adjacently to the both ends thereof, respectively. As is shown in FIG. 4, the obliquely feeding roller pairs 23 are positioned each inclined by an angle θ (in this embodiment, θ=12 degrees) scaled outwardly from the thermal conveying path 21 with respect to the conveying direction for the recording medium. That is, the obliquely feeding roller pairs 23 are mounted opened toward the downstream in the conveying direction for the recording medium (this open angle is θ). The obliquely feeding roller pairs 23 are so driven that the component of the peripheral speed thereof in the conveying direction for the recording medium is slightly higher than the peripheral speed of the conveying roller pairs 22. The nip positions 23*a* of the obliquely feeding roller pairs 23 are the same in level as the above-mentioned nip positions 22*a* of the conveying roller pairs 22. This level of the nip positions 23*a* is set to be lower than the above-mentioned arced face of the thermal conveying path 21.

Provided at the downstream side of the thermal conveying path 21 are two sets of form exhausting roller pairs 24 which are driven at a peripheral speed which is set to be higher than the above-mentioned speed component of obliquely feeding roller pairs 23 in the conveying direction for the recording medium 2 to exhaust it into an exhausted paper tray. The level of the nip positions 24*a* of the form exhausting roller pairs 24 is the same as those of the conveying roller pairs 22 and obliquely feeding roller pairs 23.

The conveying roller pairs 22, the obliquely feeding roller pairs 23 and the exhausting roller pairs 24 are intermittently driven by driving motor means synchronously to the above-mentioned paper feeding operation for the printing by the ink jet printing machine main body until the rear end of the paper under feeding is exhausted into the exhausted paper tray 25, and thus, the recording medium is conveyed without troubles.

The parameters to be set such as the maximum raised value H of the thermal conveying path 21, the inclined angle θ, etc., as above-mentioned may be selected suitably depending on conditions including the material and size to be used of the recording medium on which the thermal fixing is to be performed, and heating temperature to be used for the thermal conveying path 21. For example, it is preferable that where the recording medium such as the OHP form which tends to receive thermal expansion more easily is used said maximum raised value H and inclined angle θ be selected at larger values, respectively, whereas when the recording medium such as usual paper which does not tend to receive thermal expansion more easily is used, said maximum raised value H and inclined angle θ be selected at smaller values, respectively. Therefore, it is possible to convey the OHP form accurately along the contour of the thermal conveying path 21 to provide good fixing. Also, since smaller raised value H and inclined angle θ can be used for usual paper, a danger of any tear of the paper due to the use of large raised value H and inclined angle θ can be avoided. In general, said maximum raised value H may be about 1–4 mm, more preferably about 2–3 mm, and said inclined angle θ may be about 1–15 degrees, more preferably about 8–13 degrees. These numerical values may be selected appropriately within the range providing the most proper fixing capability in view of the utilization conditions and system construction, as described above. Incidentally, if an interchangeable or adjustable thermal conveying path 21 or obliquely feeding roller pairs 23, etc. is used, it is possible to set easily and freely said maximum raised value H and said inclined angle θ. Also, it is preferable that the heating temperature be adjustable to a desired value, for example, by detecting its temperature with temperature sensing means and on-off controlling it with a controller circuit using data from the temperature sensing means, as mentioned above. It should be noted that although the fixing temperature is desirable more than 25 degrees and less than 80 degrees, more preferably, more than 30 degrees and less than 60 degrees, this range is not limited to the above, because it is variable depending upon the kind of the recording medium or ink, as used. Furthermore, the controlling means for controlling the fixing temperature may be provided within the fixing apparatus itself, or may be provided within the image forming apparatus to control it.

With such thermal conveying path 21 as above described, since the recording medium which is being conveyed on the thermal conveying path 21 with its both ends restrained by the respective conveying roller pairs 22 is raised gradually upward by the above-mentioned protruding configuration of the thermal conveying path 21 while the recording medium is tensioned outward from the thermal conveying path 21 in the left and right directions, that is in the direction intersecting the conveying direction for the recording medium 2 by the force components in the left and right directions produced by the respective obliquely feeding roller pairs 23, any portions of the recording medium which have been created by the thermal expansion thereof are temperately tensioned on the thermal conveying path 21 so that the recording medium can be conveyed in the state that it always contacts closely with the heating surface of the thermal conveying path.

Moreover, in the illustrated embodiment, the peripheral speeds of three kinds of the roller pairs 22, 23 and 24 are set to satisfy the following relationship; that is, the peripheral speed (a) of the form exhausting roller pairs 24 is higher than the peripheral speed (b) corresponding to the component of the peripheral speed of the obliquely feeding roller pairs 23 in the conveying direction for the recording medium 2 and the speed (b) is higher than the peripheral speed (c) of the conveying roller pairs 22. This relationship of the respective peripheral speeds assures that tensile force always acts also in the conveying direction for the recording medium. Therefore, any floating of the recording medium from the surface of the thermal conveying path due to slackness of the recording medium is prevented.

Although this invention was explained in connection with the illustrated embodiments as one wherein two sets of the obliquely feeding roller pairs 23 are provided each set being positioned on the thermal conveying path 21 at each of the left and right ends thereof, additional sets of such roller pairs may be provided in the analogous manner.

It is also possible to arrange the conveying roller pairs 22 and/or the exhausting roller pairs 24 so that they act as obliquely feeding roller pairs similar to the obliquely feeding roller pairs 23 as explained above to further increase the tensile force outward from the thermal conveying path member in the direction intersecting the conveying direction for the recording medium.

Further, in the embodiments, the thermal fixing apparatus was explained as an external attachment to the ink jet printing apparatus. However, it may be an internal unit accommodated within the image forming apparatus main body and caused to be actuated if necessary.

Furthermore, although the embodiment of the subject invention was explained as the thermal fixing apparatus for printed articles output from the ink jet recording machine, it is equally applicable to thermal toner fixing apparatus for electrophotography images obtained from an electrophotography apparatus.

It has been found that this invention brings advantageous effects when it is used specially with a recording head and recording apparatus in an ink jet recording system, having means for generating heat energy as energy which is used to effect ink discharge (for example, electrothermal converter, laser beam or the like), said heat energy causing the ink to change its phase. It is because with such system high density and definition recording is obtainable.

In order to realize this, it is preferable to use the basic principle disclosed in U.S. Pat. Nos. 4,723,129 and 4,740,796, for example. This disclosed system is applicable to both of so called on-demand type and continuous type. Specially, application to the on-demand type is desirable because, by applying, to electrothermal converters arranged in relation to a sheet or liquid channels holding therein liquid (ink), at least one driving signal corresponding to record information and giving the ink rapid temperature rise beyond its nucleus boiling, to cause the electrothermal converters to generate heat energy and cause the heat active surface of the recording head to film boil, a bubble can be produced in the liquid (ink) with the one-to-one correspondence to such driving signal. Liquid (ink) is discharged through a discharge port due to growth and contraction of this bubble, and resulting at least one droplet are formed. If a driving signal comprising a pulse waveform is used, the growth and contraction of the bubbles are performed immediately and fittingly. Thus, this is suitable since a liquid (ink) discharging arrangement which is specially superior in responsibility is obtainable. As this pulse type driving signal, those which are disclosed in U.S. Pat. Nos. 4,463,359 and 4,345,263 are suited. Incidentally, it is possible to perform more suitable recording if the conditions which is described in U.S. Pat. No. 4,313,124 disclosing the invention relating to the temperature raise rate of said heat active surface are employed.

A combination structure of discharge ports, liquid channels and electrothermal converters (linear liquid channels and right-angled liquid channels) as disclosed in the specifications of the above-mentioned Patents, as well as a structure wherein a heat active portion is placed in a curved area, as shown in U.S. Pat. Nos. 4,558,333 and 4,459,600 is also usable in this invention as the recording head within the scope thereof. In addition, this invention is also effective when the construction based on Japanese Patent Application Laid-open No. 59-123670 which discloses that a common slit to a plurality of the electrothermal converters is used as the discharge portion for the electrothermal converters, or Japanese Patent Application Laid-open No. 59-138461 which discloses that an opening hole absorbing the pressure wave of the heat energy is caused to correspond to the discharge portion is used.

Further, this invention can exhibit the above-mentioned advantages more effectively, when used with a full-line type recording head having its length corresponding to the maximum recording width within which the recording apparatus can produce recording on the recording medium across a line, which full-line head may be constructed by the combination of a plurality of the recording heads filling the length of a full-line as is shown in the above-mentioned U.S. Patent specification or by a unitary recording head formed in units across said one full recording line.

In addition, this invention is effective when using a replaceable chip-type recording head which can receive an electric power and ink from the apparatus main body when attached thereto, or a cartridge type recording head accommodating therein various related units.

Also, in order to more stabilize the advantages of this invention, additional means may be preferably provided in this invention including recovering means and preparatory supporting means for the recording head. In detail, such additional means for the recording head may include capping means, cleaning means, pressurizing and absorbing means, preparatory heating means comprising electrothermal converters and/or the other heating elements, preparatory discharge mode establishing means which permits discharging other than in recording, and the other means for causing the recording head to perform the stable operation.

Further, this invention is effectively applicable to the various recording modes in the recording apparatus including a monochromatic recording mode in which black or the other mainstream color is used, a multi-color recording mode utilizing different colors and a full color recording mode utilizing color mixture. In these color recording modes, the unitary head type or multi-head combination type can be used as the recording head.

This invention was explained hereinabove with reference to the embodiments which use the liquid ink. However, this invention can also use both of ink which is solid in the room temperature and ink which is in a softening state in the room temperature. Since in the ink jet recording apparatus, in general, the temperature control is performed by adjusting the temperature of the ink itself to the range from 30 degrees to 70 degrees to bring the viscosity of the ink into the stable discharge operation range, any ink which is in the liquid state at the time of its use according to the application of the record signal may be sufficiently used in this invention. In addition, the increased temperature due to the heat energy can be positively used as energy for the phase change from the solid state to the liquid state. In this case, the ink liquefied by the application of the heat energy responsive to the record signal is discharged in the liquid state. Ink which starts its solidification at the time of its arrival to the recording-medium can be used. In order to prevent ink from evaporating, such ink may have such a property that it solidifies when let alone. In any way, this invention permits the use of ink which starts its liquefaction by the heat energy.

In such case, ink may be in the liquid or solid condition within recesses or through holes in a porous sheet which faces the electrothermal converters. In this invention, the most effective ink among those above-mentioned, is that which performs the above-mentioned film boiling system.

As explained above, this invention is so constructed that the recording medium receives the tensile force outside from the heating plate member in the direction intersecting the conveying direction for the recording medium, and thus, it is possible to ensure that the recording medium is closely contacted to the thermal conveying path (heating plate member) for fixing, and even though the recording medium is expanded due to the heating, it is possible to convey the recording medium in full contact with the heating plate member without the waving phenomenon. Accordingly, this invention provides such advantageous effects that the image formed on the recording medium can be uniformly fixed.

What is claimed is:

1. A thermal fixing apparatus for fixing an image formed by an image forming apparatus on a face of a recording medium comprising: (a) a heating member for heating said recording medium; by contact with the other face of said recording medium and (b) a surface of said heating member which contacts said recording medium having a first section and a second section, said first section being perpendicular to the conveying direction for said recording medium, central portion of said first section extremely projects into the conveying pass side for said recording medium and, the second section being parallel to the conveying direction for said recording medium, wherein the second section gradually and continuously projects into the conveying pass side for said recording medium in the direction of the downstream side.

2. A thermal fixing apparatus according to claim 1, wherein, at the both sides of said heating member in the direction perpendicular to the conveying direction for said recording medium, one or more pair of conveying members for said recording medium are settled, one of a pair for each side.

3. A thermal fixing apparatus according to claim 2, wherein said conveying members for the recording medium are so set up that they apply, to the recording medium, tensile force directing to the outside of the heating member in the directions intersecting the conveying direction for the recording medium, at the downstream side in the conveying direction for the recording medium.

4. A thermal fixing apparatus according to claim 3, wherein a pair of the conveying members for the recording medium are opened at an angle ranging from 1 degree to 15 degrees at the downstream side in the conveying direction for the recording medium, toward the outside of the heating member in the direction intersecting the conveying direction for the recording medium.

5. A thermal fixing apparatus according to claim 1, wherein said recording medium is a resin film like sheet.

6. A thermal fixing apparatus according to claim 1, wherein said thermal fixing apparatus has heating temperature measuring means which transmits information to control means of the image forming apparatus side to permit controlling to a predetermined temperature.

7. A thermal fixing apparatus according to claim 1, wherein said thermal fixing apparatus has control means for sensing the heating temperature and for controlling the same to a predetermined temperature.

8. An image forming apparatus comprising:

(a) recording medium capable of receiving an ink image;

(b) a recording means for discharging ink from a plurality of discharge ports to form said ink image on said recording medium and for carrying out scanning and movement relatively with respect to said recording medium;

(c) a support member for supporting said recording means;

(d) means for conveying the recording medium on which an image is formed;

(e) thermal fixing means for image fixing the recording medium on which a desired record image has been formed on a face thereof by the relative movement with said recording means; and (f) said thermal fixing means having a heating member for heating the recording medium by contact with the other face of said recording medium the surface of said heating member which contacts said recording medium having a first section and a second section, said first section being perpendicular to the conveying direction for said recording medium, a central portion of said first section extremely projects into the conveying pass side for said recording medium and, the second section being parallel to the conveying direction for said recording medium, wherein said second section gradually and continuously projects into the conveying pass side for said recording medium in the direction of the downstream side.

9. An image forming apparatus according to claim 10, wherein said thermal fixing means is freely attachable to a record image forming part having said recording means and said conveying means.

10. An image forming apparatus according to claim 8, wherein said recording means is such a type that ink is discharged from discharging ports by expansion and contraction of bubbles produced by the occurrence of the change of state of the ink using heat energy, and means for generating the heat energy comprises electrothermal converter means.

11. An image forming apparatus according to claim 9, wherein said image forming apparatus has control means for sensing the temperature of said thermal fixing means and controlling the same to a predetermined temperature.

12. An image forming apparatus comprising:

(a) means for conveying a recording medium on which an image is formed, said recording medium capable of receiving an ink image;

(b) a support member for supporting a recording means for (i) discharging ink from a plurality of discharge ports to form said ink image on said recording medium and (ii) carrying out scanning and movement relatively With respect to said recording medium;

(c) thermal fixing means for image fixing the recording medium on which a desired record image has been formed on a face thereof by the relative movement with said recording means; and (d) said thermal fixing means having a heating member for heating the recording medium by contact with the other face of said recording medium the surface of said heating member which contacts said recording medium having a first section and a second section, said first section being perpendicular to the conveying direction for said recording medium, a central portion of said first section extremely projects into the conveying pass side for said recording medium and, the second section being parallel to the conveying direction for said recording medium, wherein said second section gradually and continuously projects into the conveying pass side for said recording medium in the direction of the downstream side.

13. A fixing process for fixing an image on a recording medium, comprising the steps of:

conveying a recording medium having an image formed thereon to an image fixing area in a conveying path;

applying a tension to the recording medium in a direction intersecting a conveying direction at the image fixing area in said conveying path; and heating a surface opposite to an image formed surface of the recording medium at the image fixing area so as to fix said image on the recording medium, wherein said tension is a applied by heat application means provided at the image fixing area and said heat application means has a convex shape relative to the direction intersecting the conveying direction for the recording medium.

14. A process according to claim 14, wherein said recording medium is closely contacted with said heat application means by applying said tension.

15. A process according to claim 14, wherein at least a pair of conveying means are provided in both sides of said heat application means so as to open at an angle of 1 degree to 15 degree outwardly along the conveying direction for the recording medium.

16. A process according to claim 13, wherein the direction intersecting the conveying direction for the recording medium resides in both sides of the conveying direction of said recording medium.

17. A fixing process for fixing an image on a recording medium, comprising the steps of:

conveying a recording medium having an image formed thereon to an image fixing area in a conveying path;

applying a tension to the recording medium in a direction intersecting a conveying direction and a direction along the conveying direction at the image fixing area in said conveying path; and heating a surface opposite to an image formed surface of the recording medium at the image fixing area so as to fix said image on the recording medium, wherein said tension is applied by heat application means provided at the image fixing area and said heat applications means has a convex shape relative to the direction intersecting the conveying direction for the recording medium, and a convex shape gradually projecting relative to a downstream side along the conveying direction for the recording medium.

18. A process according to claim 17, wherein said recording medium is closely contacted with said heat application means by applying said tension.

19. A process according to claim 17, wherein at least a pair of conveying means are provided in both sides of said heat application means so as to open at an angle of 1 degree to 15 degree outwardly along the conveying direction for the recording medium.

* * * * *

UNITED STATES PATENT AND TRADEMARK OFFICE

CERTIFICATE OF CORRECTION

PATENT NO. : 5,485,189

DATED : January 16, 1996

INVENTORS : TOKIHIDE EBATA

It is certified that errors appear in the above-identified patent and that said Letters Patent is hereby corrected as shown below:

ON TITLE PAGE

In [56] References Cited: "Japaqn," should read --Japan,--.

COLUMN 1

Line 22, "have" should read --have been--.

COLUMN 2

Line 1, "be" should be deleted.
Line 65, "be" should read --is--.

COLUMN 3

Line 25, "protrude" should read --protrudes--.
Line 65, "feature" should read --features--.
Line 67, "accompany" should read --accompanying--.

UNITED STATES PATENT AND TRADEMARK OFFICE

CERTIFICATE OF CORRECTION

PATENT NO. : 5,485,189

DATED : January 16, 1996

INVENTORS : TOKIHIDE EBATA

It is certified that error appears in the above-identified patent and that said Letters Patent is hereby corrected as shown below:

COLUMN 4

Line 38, "an" should read --a--.

COLUMN 5

Line 34, "in." should read --in--.

COLUMN 6

Line 9, "θ)." should read --2θ).--

COLUMN 8

Line 33, "is" should read --are--.

COLUMN 9

Line 36, "recording-medium" should read --recording medium--.
Line 62, "medium;" should read --medium--.
Line 63, "medium" should read --medium;--.
Line 67, "central" should read --a central--.

COLUMN 10

Line 27, "film like" should read --film-like--.

UNITED STATES PATENT AND TRADEMARK OFFICE

CERTIFICATE OF CORRECTION

PATENT NO. : 5,485,189

DATED : January 16, 1996

INVENTORS : TOKIHIDE EBATA

It is certified that error appears in the above-identified patent and that said Letters Patent is hereby corrected as shown below:

COLUMN 11

Line 1, "claim 10," should read --claim 8,--.
Line 12, "claim 9," should read --claim 8,--.
Line 24, "With" should read --with--.

COLUMN 12

Line 4, "a" should be deleted.
Line 8, "claim 14," should read --claim 13,--.
Line 11, "claim 14," should read --claim 13,--
Line 15, "15 degree" should read --15 degrees--.
Line 34, "applications" should read --application--.
Line 47, "15 degree" should read --15 degrees--.

Signed and Sealed this

Twenty-third Day of July, 1996

*Attest:*

*Attesting Officer*

BRUCE LEHMAN

*Commissioner of Patents and Trademarks*